US005836375A

United States Patent [19]

Thöne et al.

[11] Patent Number: 5,836,375

[45] Date of Patent: Nov. 17, 1998

[54] CONTINUOUS CASTING MOLD

[75] Inventors: Heinrich Thöne, Losenstein; Franz Wimmer, Riedau, both of Austria

[73] Assignee: Voest-Alpine Industrieanlagenbau GmbH, Linz, Austria

[21] Appl. No.: 541,303

[22] Filed: Oct. 10, 1995

[30] Foreign Application Priority Data

Oct. 11, 1994 [AT] Austria ..... 1917/94

[51] Int. Cl.[6] ..... B22D 11/16; B22D 11/10

[52] U.S. Cl. ..... 164/452; 164/154.7; 164/491; 164/436

[58] Field of Search ..... 164/491, 436, 164/416, 478, 452, 154.7

[56] References Cited

U.S. PATENT DOCUMENTS

| | | | |
|---|---|---|---|
| 4,249,590 | 2/1981 | Willim . | |
| 5,517,764 | 5/1996 | Lobb, Jr. | 164/436 |

FOREIGN PATENT DOCUMENTS

| | | | |
|---|---|---|---|
| 28 14 600 | 10/1978 | Germany . | |
| 3247207 | 7/1984 | Germany | 164/491 |
| 34 27 756 | 3/1985 | Germany . | |
| 63-281755 | 11/1988 | Japan | 164/436 |
| 676211 | 12/1990 | Switzerland . | |
| 683327 | 2/1994 | Switzerland . | |
| WO 90/11149 | 10/1990 | WIPO . | |

*Primary Examiner*—Joseph J. Hail, III
*Assistant Examiner*—I. H. Lin
*Attorney, Agent, or Firm*—Hill, Steadman & Simpson

[57] ABSTRACT

A continuous casting mold for casting a strand has side walls defining an open-ended mold cavity. In order to increase the casting speed while maintaining a simple mode of construction of the continuous casting mold, the latter has the following characteristic features: at least two oppositely arranged side walls are rigidly fixed relative to each other about a pour-in section of the mold cavity and have a conicity decreasing in the running direction of the strand and, in a run-out section of the mold cavity arranged to follow the pour-in section in the running direction of the strand, include side wall sections movable relative to the strand and pressable at the strand by pressing devices, which side wall sections are arranged at a slighter conicity than the slightest conicity of the side walls of the pour-in section of the mold cavity.

22 Claims, 2 Drawing Sheets

FIG. 1
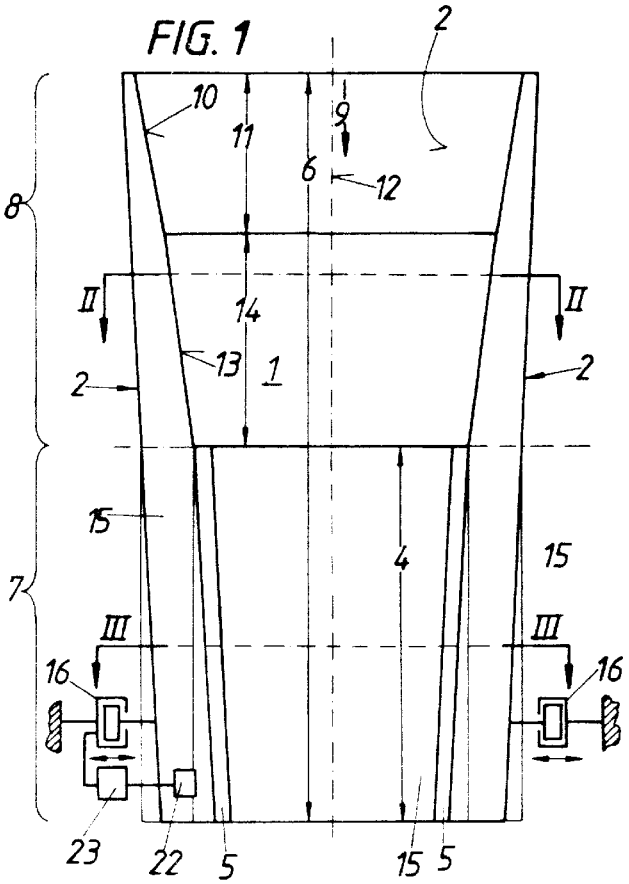
FIG. 2
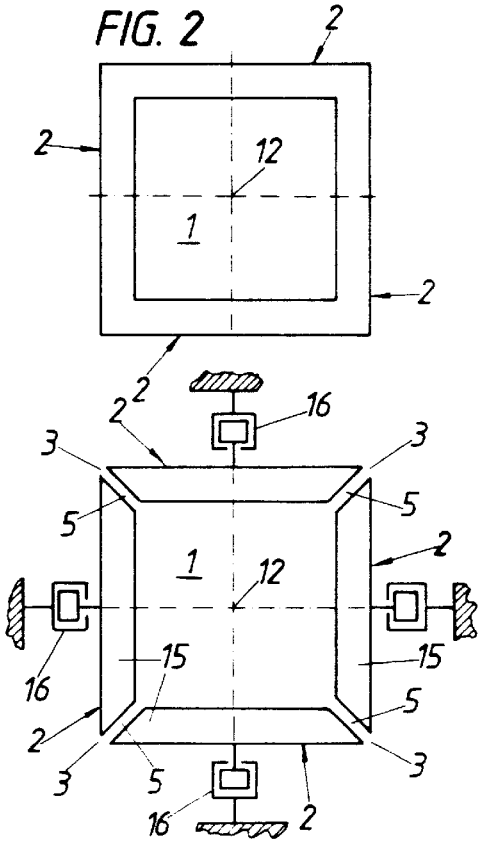
FIG. 3
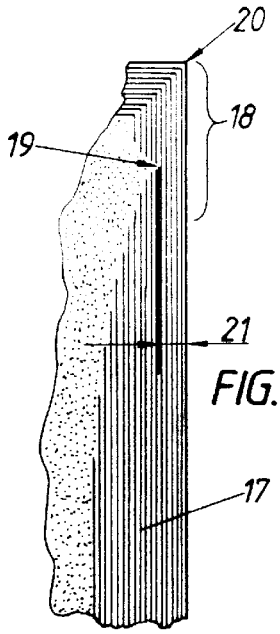
FIG. 7
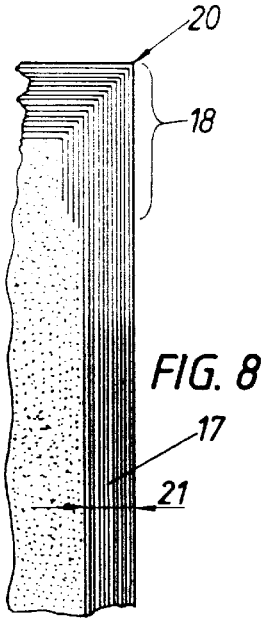
FIG. 8

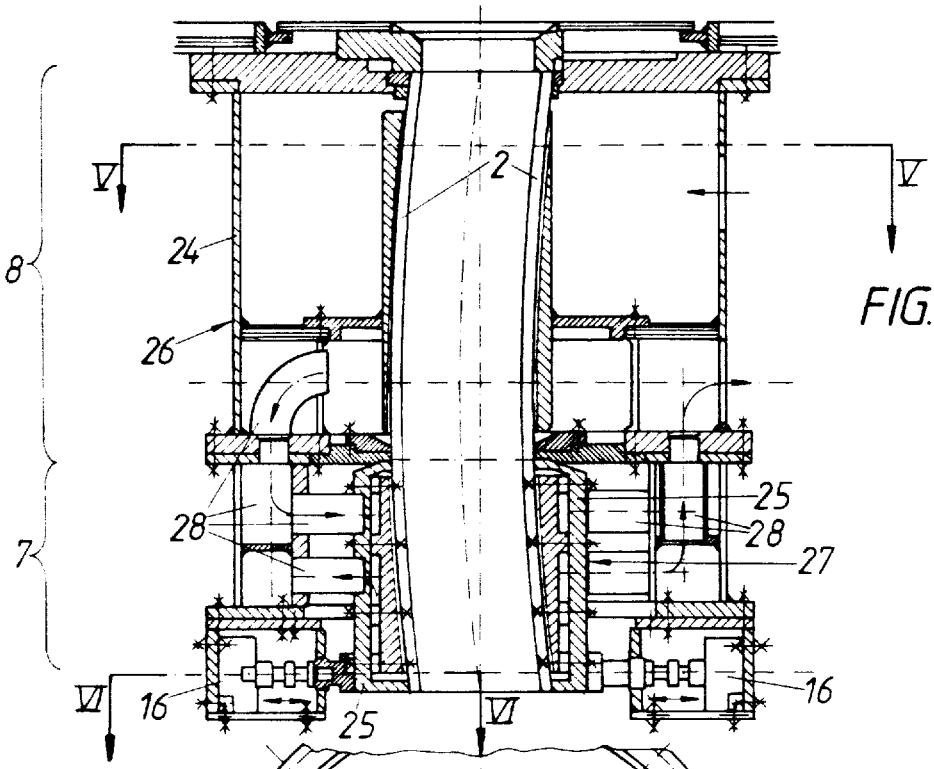
FIG. 4
FIG. 5
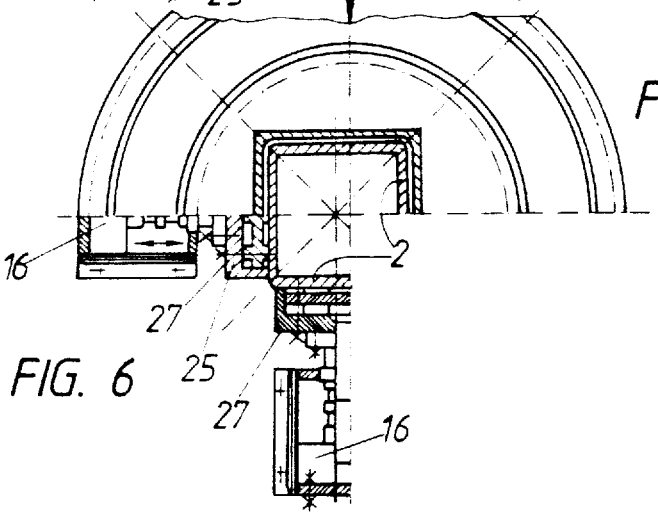
FIG. 6

CONTINUOUS CASTING MOLD

BACKGROUND OF THE INVENTION

The present invention relates to a continuous casting mold for casting a strand, in particular a fast continuous casting mold for casting billets or blooms, which mold comprises side walls defining an open-ended mold cavity as well as method of operating such a continuous casting mold.

The adjustment of the conicity of the side walls of a continuous casting mold is of great importance in continuous casting, since thereby the transmission of heat from the strand to the continuous casting mold is substantially influenced. If the conicity is too small, the strand shell or wall will detach only upon a short contact of the strand shell of the strand with the side wall of the continuous casting mold, thus forming a gap between the strand shell and the side wall of the continuous casting mold. As a result, the heat transmission decreases, the strand thus being non-uniformly cooled. A great danger consists in that remelting of the already formed strand shell may occur. This remelting may lead to a decisive reduction of the wall thickness of the strand shell and hence the risk of a breakthrough or breakout.

Therefore, the contact of the strand shell with the side walls of a continuous casting mold is of great importance, in particular in high-speed casting, i.e. at casting speeds of above 3 m/min. An essential parameter of this contact is the bearing pressure between the strand shell and the side walls of the continuous casting mold. This bearing pressure can be strongly influenced by the conicity of the side walls.

To optimize this bearing pressure, it has already been known from CH-A-676,211 to equip a continuous casting mold with a pour-in part closed on all sides and with a consecutively arranged aftercooling part, the aftercooling part being comprised of movable plates capable of being elastically adjusted against the strand transverse to the running direction of the strand. This known continuous casting mold comprises side walls that are adjustable from the run-out side end, i.e., side walls that are adjustable against the strand shell, over two thirds of its height. Thereby, it is feasible to increase the heat discharge thus obtaining a higher casting speed, yet the aftercooling part is complicated in structure and, in addition, has a transverse-part joint on the side walls that are adjustable at the strand shell in order to impart a greater mobility to the same. Moreover, this long aftercooling part calls for a relatively great mold length (structural height).

SUMMARY OF THE INVENTION

The invention aims at avoiding these drawbacks and difficulties and has as its object to provide a continuous casting mold which renders feasible the optimum discharge of heat and hence a substantially elevated casting speed as compared to the prior art. In particular, the continuous casting mold is to be of simple construction, i.e., is to provide for a good contact between the strand shell and its side walls with as few moved parts as possible. Furthermore, the continuous casting mold is to have a low structural height and only little additional weight as compared to conventional tube molds. Another requirement is that the continuous casting mold according to the invention does not require substantially increased investment costs as compared to conventional continuous casting molds.

In accordance with the invention this object is achieved by the combination of the following characteristic features:

at least two oppositely arranged side walls are rigidly fixed relative to each other about a pour-in section of the mold cavity and have a conicity decreasing in the running direction of the strand and, in a run-out section of the mold cavity arranged to follow the pour-in section in the running direction of the strand, comprise side wall sections that are movable relative to the strand and pressable at the strand by pressing means, which side wall sections are arranged at a slighter or smaller conicity than the slightest or smallest conicity of the side walls of the pour-in section of the mold cavity.

An embodiment that is particularly easy to manufacture and offers a great operational safety is characterized in that the side walls of the pour-in section of the mold cavity each are designed in one piece with the side wall sections of the run-out section of the mold cavity.

For the casting of strands having billet or bloom formats, all of the side walls of the pour-in section advantageously are designed to be interconnected in one piece in the fashion of a tube mold. However, the continuous casting mold according to the invention also may be employed for the casting of strands having slab cross sections, in which case the narrow sides of a continuous casting mold designed as a plate mold are provided with different conicities and, in the run-out section of the continuous casting mold, with side wall sections adjustable at the strand, wherein each narrow side wall preferably is provided with only one side wall section extending over the total width of the respective side wall—as is also the case with a continuous casting mold for billets or blooms.

The ideal shape of the side walls defining the pour-in section would be a parabolic progression of the same (seen in a lateral view), which means a continuous change of conicity without irregularities. However, a parabolic progression of the side walls is opposed by technical difficulties, in particular by the expensive manufacture of such side walls.

A continuous casting mold substantially less expensive to manufacture comprises a stepwise change in the conicity of the side walls of the pour-in section with the advantages to be attained with a parabolic progression of the side walls substantially being obtainable also in this case.

Continuous casting molds having different conicities over the lengths of the side walls are known, for instance, from DE-A-28 14 600 and DE-A-34 27 756. However, these known continuous casting molds have conicities that are unchangeable over their total heights, steps in the conicities being provided only in the uppermost regions of the continuous casting molds. This serves to take into account different steels, i.e., steels having different chemicals compositions.

Continuous casting molds having fixed conicities as are known from the above-mentioned documents do not keep their geometries very long due to wear, pronounced zones of weak points involving the danger of breakthroughs thus being formed on the strand shells already after relatively short periods of operation. These can be reduced only by drastically lowering the casting speed. Continuous casting molds of this kind, therefore, are suitable for conventional casting speeds only.

Preferably, the conicities of the side walls in the pour-in section of the mold cavity according to the invention each are designed in two steps, the conicity of the first step ranging between 1.1 and 1.4% per meter of mold length, preferably amounting to about 1.25% per meter of mold length, and the conicity of the second step ranging between 0.7 and 0.9% per meter of mold length, preferably amounting to about 0.8% per meter of mold length. Suitably, the conicities of the movable side wall sections adjustable at the strand range between 0.5 and 0.85% per meter of mold length, preferably amount to about 0.75% per meter of mold length.

Advantageously, the pour-in section formed by side walls rigidly fixed against each other extends over a length of 45 to 65%, preferably of about 55%, of the mold length (measured in the running direction of the strand).

A preferred embodiment of the continuous casting mold is characterized in that the pressing means is devised as an adjustment means for adjusting the side wall sections of the run-out section of the mold cavity, preferably as a pressure medium cylinder, each engaging at the lower end region of a side wall section.

Suitably, the side wall sections of the run-out section of the mold cavity are each externally provided with supporting walls defining a hollow space with the side wall sections, through which a coolant flows. Instead of the hollow space, also an open spray cooling may be provided, in which case the side wall sections are externally equipped with reinforcement ribs, etc.

A structurally simple continuous casting mold accordingly easy to manufacture is characterized in that the side walls in the pour-in section of the mold cavity are provided with supporting walls that are independent of the side wall sections of the run-out section of the mold cavity and serve to form a hollow space through which a coolant flows, wherein, however, the side walls extend over the entire mold length in one piece.

Advantageously, the side wall sections of the run-out section of the mold cavity are equipped with temperature measuring means, the temperature measuring means suitably being connected with the pressing means of the side wall sections of the run-out section of the mold cavity via an adjustment or control unit.

The continuous casting mold according to the invention advantageously is operated by adjusting the side wall sections of the run-out section of the mold cavity to a fixed value of conicity during continuous casting.

It is particularly advantageous if the temperature of the side wall sections of the run-out section of the mold cavity is continuously monitored by a temperature measuring means and the adjustment of the conicity of these side wall sections is effected in dependence on the temperature value measured, thus being able to take into account also changing operation conditions.

If the temperature of the side wall sections of the run-out section of the mold cavity drops, these side wall sections suitably are readjusted to a greater conicity.

Another preferred mode of operation of the continuous casting mold according to the invention reducing the frictional forces prevailing between the strand and the side walls of the continuous casting mold is characterized in that the conicities of the side wall sections of the run-out section of the mold cavity with a reciprocating continuous casting mold are reduced over a short time at each drop of the relative speed between the strand and the side walls of the continuous casting mold to zero.

A reduction of the frictional forces is feasible with a reciprocating continuous casting mold also by reducing or eliminating the pressing force of the side wall sections of the run-out section of the mold cavity against the strand over a short time at each drop of the relative speed between the strand and the side walls of the continuous casting mold to zero.

In the following, the invention will be explained in more detail by way of two exemplary embodiments and with reference to the accompanying drawings.

BRIEF DESCRIPTION OF THE DRAWINGS

FIG. 1 is a longitudinal cross sectional view through a continuous casting mold in accordance with the present invention;

FIG. 2 is a reduced cross sectional view taken along the lines II—II of FIG. 1;

FIG. 3 is a reduced cross sectional view taken along the lines III—III of FIG. 1;

FIG. 4 is a longitudinal cross sectional view of a continuous casting mold for blooms having a curved mold interior in accordance with the present invention;

FIG. 5 is a partial cross sectional view taken along the lines V—V of FIG. 4;

FIG. 6 is a partial cross sectional view taken along the lines VI—VI of FIG. 4;

FIG. 7 is a diagrammatical cross sectional view of a strand departing from the edge region to the center of a side of a strand shell from a conventional continuous casting mold; and FIG. 8 is a partial cross sectional view of a strand departing from the edge region to the center of a side of a strand shell of a continuous casting mold in accordance with the present invention.

DESCRIPTION OF THE PREFERRED EMBODIMENTS

According to the embodiment of a continuous casting mold in accordance with the invention represented in FIGS. 1 to 3, a mold cavity 1 approximately having the cross section of a bloom is surrounded by side walls 2 constituting an integral structural unit. The side walls 2 define a one-piece tube having square cross section, which tube has slits 5 in the corner regions 3 of the side walls 2, extending over a given length 4. The slits 5 from the run-out side end of the continuous casting mold extend over a height region amounting to between 35 and 55% of the total length 6 of the continuous casting mold. In the following, this lower region of the continuous casting mold is denoted as the run-out section 7 of the mold cavity 1.

The side walls 2 closedly surrounding the pour-in section 8 of the mold cavity 1, i.e., the upper part of the mold cavity 1, each have a conicity that decreases in the running direction 9 of the strand. The conicity is designed in two steps. The first step 10 extends over a height region 11 amounting to between 15 and 30% of the total length 6 of the continuous casting mold and the conicity is approximately 1.25% per meter of mold length. By "conicity" the inclination of a side wall 2 relative to the central longitudinal axis 12 of the continuous casting mold is understood. With a mold length of 1 m, a deviation of the distance of the lower end of the side wall in the direction towards the central longitudinal axis 12 of 1.25 mm relative to the distance of the upper end of this side wall 2 would result at a conicity of 1.5%/m of mold length. The preferred conicity range is between 1.1 and 1.3% per meter of mold length for the first step 10.

The second conicity step 13 has a conicity of 0.8% per meter of mold length, and is preferably in a range of 0.7 to 0.9% per meter of mold length. The height 14 of the second conicity step 13 is approximately equal to the height 11 of the first conicity step 10, and slightly larger in the exemplary embodiment according to FIG. 1.

The conicity of the side wall sections 15 defining the run-out section 7 of the mold cavity 1 is approximately 0.75% per meter of mold length, is preferably in a range of between 0.65 and 0.85% per meter of mold length. Pressing means 16 which are preferably designed as pressure medium cylinders engage the lower ends of the side walls and serve to press the side walls 2 against the strand. Thereby, an intimate contact between the side walls 2 and the strand shell 17 of the strand over the total length of the continuous casting mold and hence an efficient heat transmission as well as a uniform strand shell formation without any weak points can be safeguarded. Thus, the shell grows strongly and homogenously, which is particularly important in the immediate edge region 18 of the strand shell 17. For, in the edge region 18 the corner rigidity of the strand is very strongly influenced by the interplay of shrinkage behavior, ferrostatic pressure, heat transmission and shell growth.

It has been shown that the corner rigidity of the strand in the very first, i.e., uppermost region of the mold cavity 1 instantly grows so intensively that the ferrostatic pressure is not able to keep the strand shell 17 in contact with the side walls 2 of the continuous casting mold and to compensate for the shrinkage of the strand by expanding the strand shell 17. In the further course of the mold cavity 1, i.e., in a region farther below, the effect of the comer rigidity decreases relative to the ferrostatic pressure.

The following happens with continuous casting molds of conventional modes of construction:

If the contact between the strand shell 17 and the side walls 2 of the continuous casting mold gets lost, the contribution of thermal conductivity to thermal transmission is missing there. What remains is nothing more than heat exchange by radiation. As a result, the shell growth instantly falls behind that of neighboring zones of the strand abutting on the side walls 2 of the continuous casting mold. Zones of weak points 19 with slighter shell thicknesses 21 form each closely adjacent an edge 20. In the edge 20 itself, the two-dimensional discharge of radiation heat compensates for the omission of thermal conductivity. The local falling behind of the growth induces an inhomogenous strand shell 17 thus exhibiting more stresses and being more prone to cracks over the periphery of the bloom. The local weak points 19 constitute risks of breakthroughs.

The formation of such a weak point 19 is apparent from FIG. 7, in which a strand shell 17 forming when casting a bloom having a cross sectional format of 165×165 mm at a relatively low casting speed of 2 m/min is shown. The liquid core of the strand is indicated by dots.

When casting with a continuous casting mold according to the invention, a strand shell as illustrated in FIG. 8 forms, wherein it is clearly apparent that it is exactly the jeopardized edge region 18 of the strand which has a particularly strong shell. No weak point can be recognized, although casting was effected at a higher casting speed of 4 m/min. The lengths 6 of the continuous casting molds with which a strand having weak points 19 according to FIG. 7 and a strand having a strand shell 17 according to FIG. 8 were cast, were identical; they amounted to 800 mm.

By the continuous casting mold according to the invention, a nearly constant application pressure is achieved between the strand shell 17 and the side walls 2 of the continuous casting mold over the entire length 6 of the continuous casting mold, wherein and this is of particular relevance—this constant shell application pressure can be achieved even after an extended period of operation of the continuous casting mold, i.e., after a greater wear of the side walls 2.

The continuous casting mold according to the invention allows for casting speeds of at least 4 to 5 m/min even with larger bloom formats, such as, e.g., bloom formats having side lengths of up to 180 mm, and despite this a strongly homogenous shell growth with very few stresses of the strand shell 17 and hence a high operational safety are ensured.

The continuous casting mold according to the invention allows for the adjustment of the conicities of the side walls 2 in the run-out section 7 of the mold cavity 1 to current casting speeds and steel qualities, wherein special operation conditions, such as the cast-on phase and hence also the extraction of the starter bar, can be taken into consideration.

By monitoring the heat transmission in the run-out section 7 of the mold cavity 1, between the strand shell 17 and the mold side walls 2—which, for instance, may be realized by monitoring the temperature of the side walls 2 by a temperature measuring means 22—it is feasible to find out at once whether the strand shell 17 in that section 7 still is in good contact with the side walls 2. If this is not the case, the temperature of the mold side walls 2 will drop there, which temperature drop may be used via a control means 23 to appropriately correct the position of the side walls 2 in that section 7.

In the course of movement of the strand extraction and reciprocation of the continuous casting mold there are points of time at which no relative movement occurs between the strand shell 17 and the side wall 2, i.e., the relative speed between the strand and the continuous casting mold is zero. When reinitiating the relative movement, the frictional force between the strand shell 17 and the side wall 2 increases to static friction, returning to sliding friction after this. In order to avoid any extraction force peak involved therein along with the higher stress thereby exerted on the shell, the frictional force advantageously is reduced at those points of time by automatically reducing the application pressure.

As is apparent from the embodiment of a continuous casting mold for blooms represented in FIGS. 4 to 6, the side walls 2, which are made of copper or a copper alloy, are supported by means of supporting walls 24, 25 both in the pour-in section 8 of the mold cavity 1, in which the side walls 2 are adjusted with rigid conicities, and in the run-out section 7, which supporting walls 24, 25 each form a water box 26, 27 through which a coolant flows. Also in that case, the side walls 2 are comprised of tubes provided with slits 5 in the lower run-out section. The upper tube-shaped portion is peripherally surrounded by a water box 26, whereas the lower side wall sections 15 capable of being adjusted against the strand each comprise their own supporting walls 25 and their own water boxes 27 formed by these supporting walls 25. When adjusting the side wall sections 15 of the run-out section 7, the side walls 2 are elastically deformed, i.e., the material of the side walls 2 itself functions as an articulation. The water boxes 27 each are flow-connected with the water box 26 via tube connections 28.

Due to the integral design of the side walls 2 over the entire mold length 6, separation sites and hence starting points for shell saggings or similar disturbances are avoided. It can be seen that the side walls 2 of the run-out section 7 of the mold cavity 1 in principle correspond to a continuous casting mold composed of individual plates. The pressing means 16 in that case are designed as pneumatic cylinders.

The movement of the side wall sections 15 in the run-out section 7 of the mold cavity 1 may be effected either by observing a given course of adjustment or by adjusting a predetermined application pressure, i.e., a defined pressure occurring between the strand shell 17 and the side walls 2.

The deformations of the side walls 2 are only slight such that no disturbances in controlling may result. The pneumatic cylinders 16 could be replaced with spring assemblies, hydraulic or electromechanic elements.

What we claim is:

1. A continuous casting mold arrangement for casting a strand including a billet or bloom, said arrangement comprising:

a continuous casting mold having a mold length and side walls defining an open-ended mold cavity, said mold cavity having a pour-in section at one end of said mold cavity and a ran-out section arranged to follow said pour-in section in the running direction of said strand, at least two oppositely arranged side walls of said mold being rigidly fixed relative to each other about said pour-in section of said mold cavity, each of said at least two oppositely arranged side walls having a conicity decreasing in the running direction of said strand, and having a side wall section in said run-out section of said mold cavity, said side wall sections being constructed so as to be movable relative to said strand and each side wall section being arranged at a smaller conicity than the smallest conicity of each of said at least two oppositely arranged side walls of said pour-in section of said mold cavity; and pressing means being provided to press said side wall sections toward said strand.

2. A continuous casting mold arrangement as set forth in claim 1, wherein each of said at least two oppositely arranged side walls of said pour-in section of said mold cavity are constructed in one piece with said respective side wall section of said run-out section of said mold cavity.

3. A continuous casting mold arrangement as set forth in claim 1, wherein all of said side walls of said pour-in section are designed to be interconnected in one piece in the manner of a tube mold.

4. A continuous casting mold arrangement as set forth in claim 1, wherein each of said side walls of said pour-in section of said mold cavity have a conicity decreasing in steps.

5. A continuous casting mold arrangement as set forth in claim 4, wherein each of said side walls of said pour-in section of said mold cavity have a conicity comprising a first step and a second step, said first step of said conicity ranging between 1.1 and 1.4% per meter of mold length and said second step of said conicity ranging between 0.7 and 0.9% per meter of mold length.

6. A continuous casting mold arrangement as set forth in claim 5, wherein said first step of said conicity is about 1.25% per meter of mold length and said second step of said conicity is about 0.8% per meter of mold length.

7. A continuous casting mold arrangement as set forth in claim 1, wherein each of said movable side wall sections capable of being pressed at said strand have a conicity ranging between 0.5 and 0.85% per meter of mold length.

8. A continuous casting mold arrangement as set forth in claim 7, wherein said conicity of said movable side wall sections capable of being pressed at said strand is about 0.75% per meter of mold length.

9. A continuous casting mold arrangement as set forth in claim 1, wherein said pour-in section comprised of said side walls rigidly fixed relative to each other has an extension over a length of 45 to 65% of said mold length, measured in the running direction of said strand.

10. A continuous casting mold arrangement as set forth in claim 9, wherein said extension is about 55%.

11. A continuous casting mold arrangement as set forth in claim 1, wherein said pressing means is configured as an adjustment means engaging at each of said side wall sections of said run-out section of said mold cavity in their lower end regions and adapted to adjust each of said side wall sections of said run-out section of said mold cavity.

12. A continuous casting mold arrangement as set forth in claim 11, wherein said adjustment means is designed as a pressure medium cylinder.

13. A continuous casting mold arrangement as set forth in claim 1, further comprising a first supporting wall provided externally on each of said side wall sections of said run-out section of said mold cavity to define with the respective one of said side wall sections a first hollow space to receive a coolant flowing therethrough.

14. A continuous casting mold arrangement as set forth in claim 13, further comprising a second supporting wall independent of said first supporting wall and provided on each of said at least two oppositely arranged side walls at the height of said pour-in section of said mold cavity so as to define a second hollow space to receive a coolant flowing therethrough, said side walls extending in one piece over all of said mold length.

15. A continuous casting mold arrangement as set forth in claim 1, further comprising a temperature measuring means provided on each of said side wall sections of said run-out section of said mold cavity.

16. A continuous casting mold arrangement as set forth in claim 15, further comprising an adjustment or control unit provided to connect said temperature measuring means with said pressing means of said side wall sections of said run-out section of said mold cavity.

17. A method of operating a continuous casting mold arrangement for casting a strand including a billet or bloom, said mold arrangement being a continuous casting mold having a mold length and side walls defining an open-ended mold cavity, said mold cavity having a pour-in section and a run-out section arranged to follow said pour-in section in the running direction of said strand, at least two oppositely arranged side walls of the mold being rigidly fixed relative to each other about said pour-in section of said mold cavity, each of the oppositely arranged side walls having a conicity decreasing in the running direction of said strand and including a side wall section provided in said run-out section of said mold cavity, said side wall sections being constructed so as to be movable relative to said strand and each being arranged at a smaller conicity than the smallest conicity of each of said at least two oppositely arranged side walls of said pour-in section of said mold cavity, and pressing means for pressing said side wall sections at said strand, said method including a step of adjusting said side wall sections of said run-out section of said mold cavity to a fixed value of conicity for each continuous casting operation.

18. A method as set forth in claim 17, further comprising providing a temperature measuring means, continuously monitoring the temperature of said side wall sections of said run-out section of said mold cavity by said temperature measuring means so as to obtain a measured temperature value, and adjusting said conicity of each of said side wall sections in dependence on said measured temperature value.

19. A method as set forth in claim 18, further comprising readjusting said conicity of each of said side wall sections of said run-out section of said mold cavity to a greater conicity in case of a temperature drop in the measured temperature value of said side wall sections.

20. A method as set forth in claim 17, wherein said continuous casting mold is a reciprocating continuous casting mold creating a change in the relative speed of the strand moving by the side walls during the casting operation and said method comprises a step of reducing over a short time said conicity of said side wall sections of said run-out section of said mold cavity at each drop of the relative speed between said strand and said side walls of said continuous casting mold to zero.

21. A method as set forth in claim 17, wherein said continuous casting mold is a reciprocating continuous casting mold which creates changes in a relative speed of the strand moving by the side walls during the casting operation and said method further comprises reducing over a short time the force by which said side wall sections of said run-out section of said mold cavity are pressed at said strand, at each drop of the relative speed between said strand and said side walls of said continuous casting mold to zero.

22. A method as set forth in claim 17, wherein said continuous casting mold is a reciprocating continuous casting mold, which changes the relative speed of the strand moving by the side walls during the casting operation and said method further comprises eliminating over a short time the force by which said side wall sections of said run-out section of said mold cavity are pressed at said strand, at each drop of the relative speed between said strand and said side walls of said continuous casting mold to zero.

* * * * *